United States Patent [19]

Kim

[11] Patent Number: 4,750,509

[45] Date of Patent: Jun. 14, 1988

[54] FOLDING DEVICE OF A TENT-FRAMEWORK

[76] Inventor: Soon-Tae Kim, 250-17, Chamsil-Dong, Kangdong-Ku, Seoul, Rep. of Korea

[21] Appl. No.: 867,845

[22] Filed: May 27, 1986

[30] Foreign Application Priority Data

| | | | |
|---|---|---|---|
| Nov. 25, 1985 | [KR] | Rep. of Korea | 15535/85 |
| Dec. 4, 1985 | [KR] | Rep. of Korea | 16152/85 |
| Feb. 4, 1986 | [KR] | Rep. of Korea | 1228/86 |
| Feb. 11, 1986 | [KR] | Rep. of Korea | 1519/86 |

[51] Int. Cl.[4] ..... E04H 15/36; E04H 15/42; E04H 15/28; E04H 12/18

[52] U.S. Cl. ..... 135/102; 135/105; 135/98; 135/30; 52/646

[58] Field of Search ..... 135/102, 104, 103, DIG. 9, 135/98, 29, 20 R, 30, 117, 120, 105, 106; 43/348, 353, 100, 102; 52/646

[56] References Cited

U.S. PATENT DOCUMENTS

| | | | |
|---|---|---|---|
| 1,097,191 | 5/1914 | Schmidt | 135/30 |
| 1,846,496 | 2/1932 | Mills | 135/98 |
| 2,214,660 | 9/1940 | Darling | 403/102 X |
| 2,286,655 | 6/1942 | Supnick | 403/100 |
| 2,549,573 | 4/1951 | Clark | 403/102 X |
| 2,689,579 | 9/1954 | Sartori | 135/102 |
| 2,808,846 | 10/1957 | Jonsson | 135/98 |
| 3,177,882 | 4/1965 | Militano | 135/30 X |
| 3,305,204 | 2/1967 | Babin | 403/102 X |
| 3,541,566 | 11/1970 | Riebsamen | 403/102 X |
| 4,026,313 | 5/1977 | Zeigler | 135/102 |
| 4,074,682 | 2/1978 | Yoon | 403/100 X |
| 4,202,363 | 5/1980 | Watts et al. | 135/105 X |
| 4,285,354 | 8/1981 | Beavers | 135/106 X |
| 4,352,362 | 10/1982 | Nichols | 135/98 |
| 4,627,210 | 12/1986 | Beaulieu | 135/106 X |
| 4,637,748 | 1/1987 | Beavers | 135/98 X |

FOREIGN PATENT DOCUMENTS

| | | | |
|---|---|---|---|
| 2113543 | 8/1983 | United Kingdom | 135/20 R |

*Primary Examiner*—Robert A. Haffer
*Assistant Examiner*—D. Neal Muir
*Attorney, Agent, or Firm*—Donald C. Feix; T. M. Freiburger

[57] ABSTRACT

A tent and folding tent framework which enable quick and easy setup and taking down of the tent include a central hub member about which six ribs are pivotable. The hub member or fixed disk is made of plastic material and includes openings which enable the ribs to be easily assembled into the hub. Each rib includes two joints which pivot through 180 degrees. The joints are biased by springs toward the open position and include locking sleeves which are biased toward the locking position. The six ribs are loosely attached to the tent fabric via fabric loops, so that the entire framework is on the outside of the tent. A single user can easily open and set up the tent, or take down and store the tent, without assembling components and assistance.

4 Claims, 3 Drawing Sheets

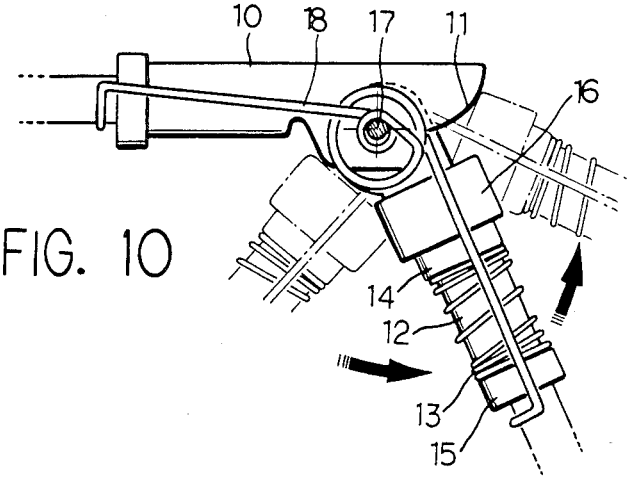
FIG. 10
FIG. 11
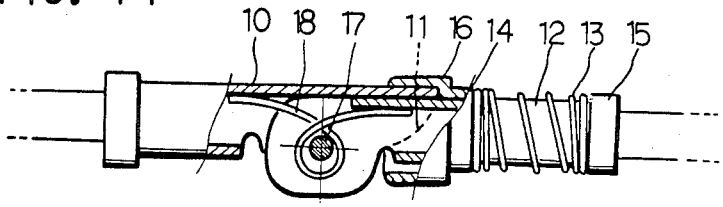
FIG 12
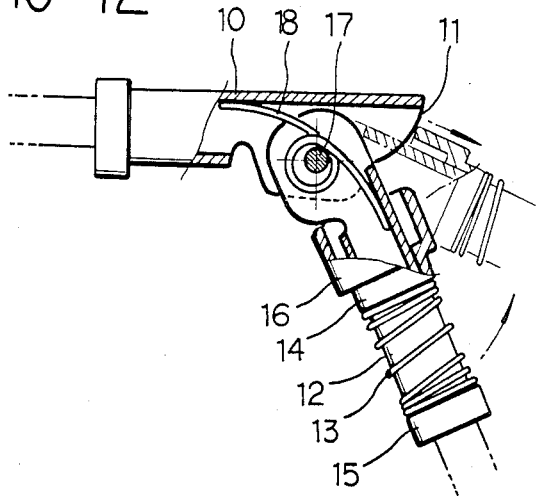

FOLDING DEVICE OF A TENT-FRAMEWORK

BACKGROUND OF THE INVENTION

Technical Field

The present invention relates to a tent construction and tent framework, more particularly to a folding framework wherein a series of ribs are jointed to a fixed disk or central hub.

In the prior art tent frameworks have been known wherein many U-shaped brackets were welded to the upper side of a flat metal disk. Framework extension pieces comprising the remainder of the tent frame were then joined with the U-shaped device by means of a joint pin or other similar means. Individual welding of the brackets to the disk resulted in inefficient and costly manufacture. Further, the joint pin and bracket were subject to bending or breakage as a result of the forces caused by the bending of the tent framework in its set position. The articulation of the tent framework also tended to distort the pin opening, causing the joint pin to be advanced or retracted when a connecting tube of the framework was pushed or pulled. As a result, such a device in the prior art required additional force to set up or take down. This also resulted in a more cumbersome operating framework, making it more difficult for a single individual to operate.

SUMMARY OF THE INVENTION

The present invention relates to an improved hub device for the apex of a tent, to an improved tent framework including the hub device, and to an improved tent construction using these elements. The hub device is located at the apex of the tent frame, and receives a series of tubular or rod-like ribs or frame pieces to be joined to the hub in a radial pattern with respect to the hub. Attachment of the ribs to the hub member is accomplished in a manner which permits easy articulation of the ribs without the necessity of using separable pins.

The hub, formed from a synthetic resin, is efficiently manufactured with a series of joint openings designed to accept the ends of the ribs. The ribs are easily and quickly assembled into the hub member by extending the rib into the opening, rotating the end of the rib and then locking it into place so as to be rotatable with respect to the hub. The ribs are not removed from the hub once installed.

Once attached to the hub, the ribs or frame pieces can be folded into a compact shape for storage of the tent, or extended to operate as the supporting structure of the tent without having to disassemble each rib into its component pieces, nor any ribs from the hub. In this way the hub and rib framework of the present invention, when loosely attached exteriorly to the fabric of a tent, permits one person to easily set up or take down the tent in a minimum amount of time without detaching the tent from the framework or disassembling any of the framework. It is therefore among the object of this invention to provide a lightweight and efficiently constructed tent and tent framework which facilitates the rapid and easy setup or taking down of the tent. It is further among the objects of the invention to provide such a device which is easily, efficiently and economically manufactured without necessitating separate assembly of each connection device securing the ribs to the hub. Still further, it is among the objects of the invention to provide such apparatus which permits easier and smoother articulation of tent frame ribs about the central hub while reducing the incidence of bending or breakage caused by tensions produced from the stressed ribs when in the set up position.

BRIEF DESCRIPTION OF THE DRAWINGS

FIG. 10 is an other view showing an embodiment in which a spring is installed on the outside of an articulated joint.

FIG. 11 is a partially sectioned view showing another embodiment of a joint, with a spring installed inside the joint.

FIG. 12 is a partially sectioned view similar to FIG. 11, showing the joint folded.

DESCRIPTION OF THE PREFERRED EMBODIMENT

Figure 1:
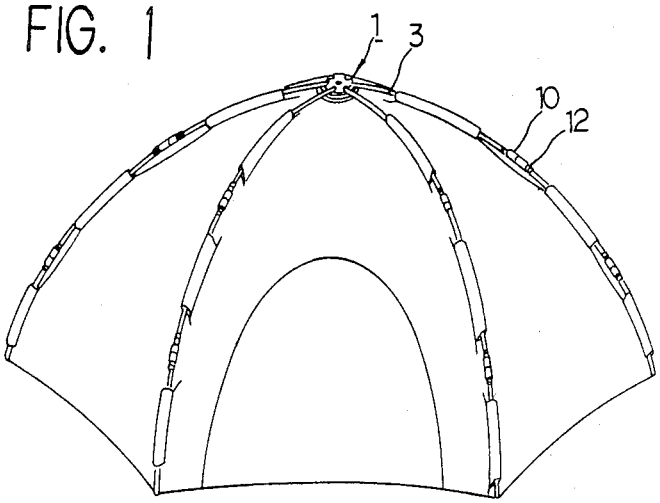
FIG. 1 is a general perspective view of an assembled tent framework and tent in accordance with the present invention.
Figure 2:
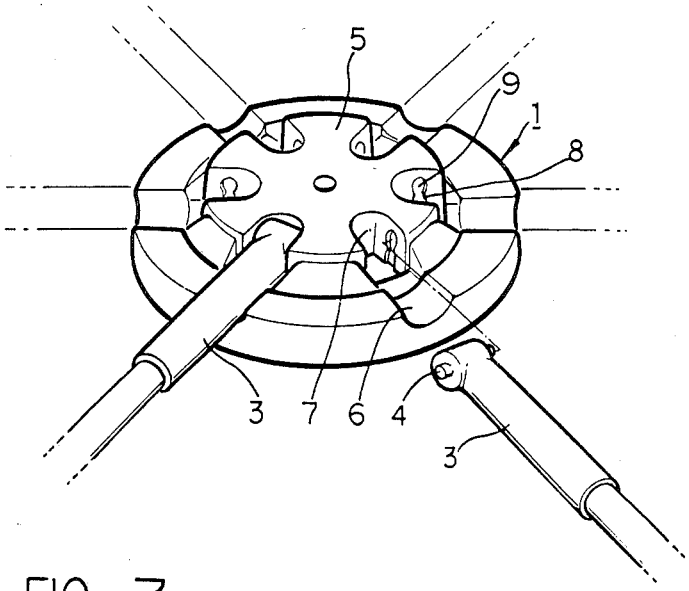
FIG. 2 is a perspective view of a joint plate or hub member to which frame pieces or ribs are jointed.

Referring to FIGS. 1 and 2, a joint plate 5 is formed at the center of a central hub member 1 preferably formed of synthetic resin, with the joint plate 5 extending upwardly as shown. A plurality of U-shaped concave openings 7 are formed in the periphery of the joint plate 5 and spaced radially around the joint plate, for receiving the ends of ribs or framework pieces 3. Each opening 7 has a joint groove 9 located on each of the side walls of the opening, which are substantially perpendicular to the outer periphery of the joint plate 5. Each joint groove 9 is further provided with two hanging jaw devices 8 located across from one another on the walls of the joint groove 9. A plurality of approximately half-round rib grooves 6 are spaced radially about the perifery of the disk or hub member 1 and located adjacent to each opening 7. Preferably six of these openings and rib grooves are provided around the perifery of the hub member 1, for receiving six radially extending ribs 3 as indicated.

Two joint pins 4 are located at the end of each rib 3, and these pins enter the openings 7. The pins are on opposite sides of the rib end so that when the rib is fixed into position in the openings 7, the pins engage with the joint groove and are held therein by the hanging jaw devices 8, allowing each tube 3 to pivot about the pins 4.

Figure 3:
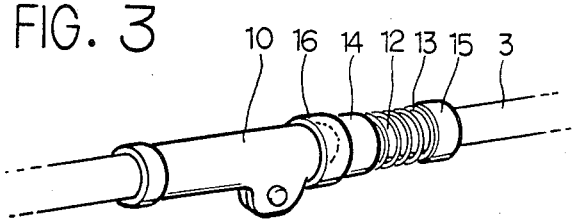
FIG. 3 is a perspective view of an articulated joint of a framework.
Figure 8:
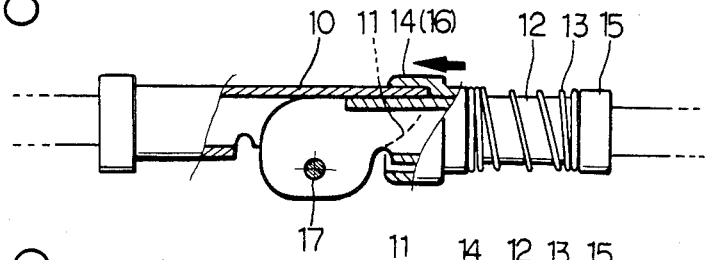
FIG. 8 is a sectional view showing the construction of an articulated, locking joint included in the rib.
Figure 9:
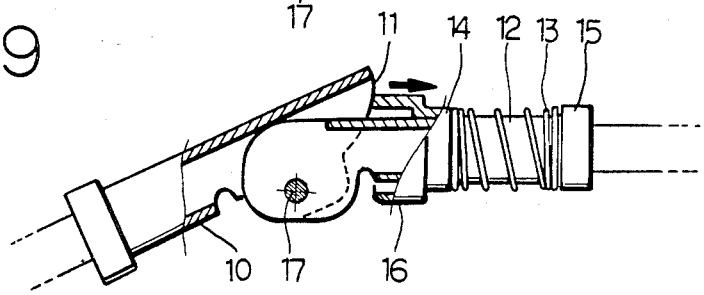
FIG. 9 is a view similar to FIG. 8, showing the joint in an unlocked configuration, and indicating the manner in which the joint can be released.

Two framework members or ribs 3, or sections of a rib 3, may be connected by means of a connecting tube 10 as shown in FIG. 3. The connecting tube 10 engages with a locking tube 12, with pivoting provided by means of a supporting shaft 17 (FIGS. 8 and 9) so that the ribs may be locked in straight alignment with one another as shown in FIG. 8 or rotated or pivoted with respect to each other about the pivot shaft 17 as shown in FIG. 9. In this way, the two rib sections may be folded side by side.

Further, an extending piece 11 shown in FIGS. 8 and 9, which is half-round and sloped inside, extends from the connecting tube 10 so that it may be engaged and held by a slider-socket tube 14 positioned on the connecting tube 12. Thus, the tent ribs or rib section 3 are made rigid together in straight alignment as shown in FIG. 8.

A spring 13 surrounding the tube 12 and held between the slider-socket 14 and a flange 15, pushes on the slider-socket tube 14 to urge it toward the locking position with the extension 11. The fixed engagement may be released by pushing the slider-socket 14 rearward toward the flange 15, and pivoting the rib section 3 about the pivot shaft 17.

As shown in FIGS. 10–12, a torsion type spring 18 may be included in the articulated joint so as to keep the rib sections and connection tubes 10 and 12 urged toward the unfolded, aligned, open position. In the embodiment shown in FIG. 10, the torsion type spring 18 is shown mounted on the outside of the joint.

In FIGS. 11 and 12 an embodiment is illustrated wherein the torsion type spring 18 is located on the inside of the articulated joint.

Figure 4:
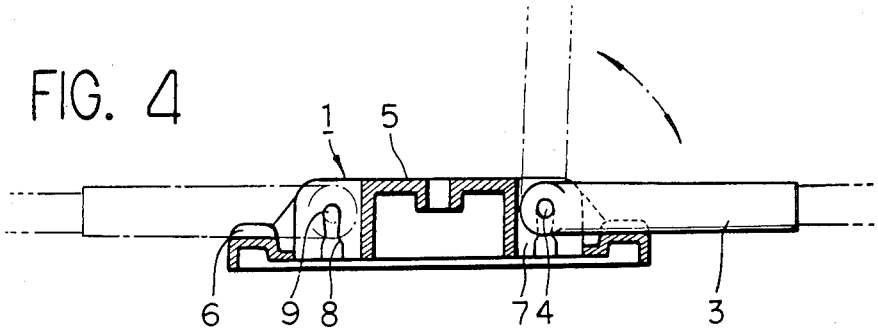
FIG. 4 is a sectional view showing a connected configuration of a central hub with the ribs.
Figure 5:
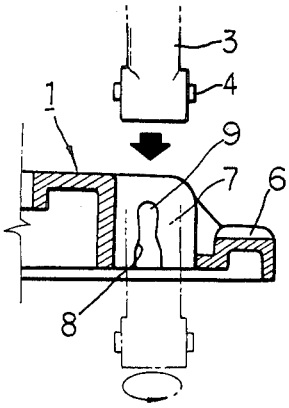
FIGS. 5, 6 and 7 are similar sectional views showing in succession the manner in which the end of a tent frame rib is inserted into and locked into place in the central hub.
Figure 6:
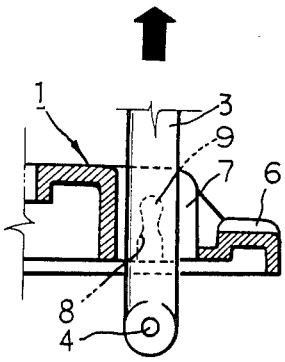
Figure 7:
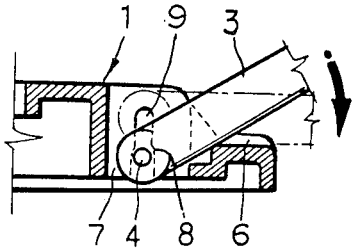

In accordance with the present invention, the framework is assembled by steps illustrated in FIGS. 5, 6 and 7 and also FIG. 4. The ribs 3 are inserted through the concave openings 7 on the central hub member or disk 1, by aligning the pins 4 perpendicular to the position they will occupy when engaged in the joint grooves 9, as shown in FIG. 5. Then the joint pin 4 of the rib is placed below the joint groove 9 as illustrated in broken lines in FIG. 5, rotated to the position shown in FIG. 6, and lifted upwardly until the joint pins 4 extend into the lower portions of the hanging jaws 8. As shown in FIG. 7, the rib 3 may then be pivoted downwardly with a small amount of force, to snap the joint pins 4 up into the top portion of the joint grooves 9.

As thus constructed, the ribs 3 freely pivot over a range greater than 90 degrees, from an opened position substantially parallel to the plane of the disk or hub 1 as shown in FIGS. 1, 2 and 4, to an upwardly folded position generally perpendicular to the disk as shown in broken lines in FIG. 4.

As shown in FIG. 1, a tent fabric is supported by the assembled and unfolded ribs 3 in the set up configuration of the tent, preferably by loops of fabric through which the ribs pass as shown. The tent is thus loosely attached to the framework members or ribs 3 as shown, in such a manner that in the assembled and set up tent, the tent hangs from the framework made up of the central hub 1 and the ribs 3, with the fabric generally in a taut configuration as illustrated.

In the fold-up storage position of the tent and tent framework shown in FIG. 1, all articulated joints of the ribs 3 are folded substantially at 180 degrees, and the joints of the ribs 3 with the central hub member 1 are pivoted up substantially at 90 degrees, with the immediate rib sections closely clustered together above the central hub member. In this way, the tent is stored very compactly and is quite short in stored length. When the tent is to be set up, the ribs 3 may be unfolded by retracting the slider socket tube 14 of each rib until the extension portion 16 of the slider socket 14 is clear of the extending piece 11. The rib sections 3 can then pivot about the pivot shaft 17 of the joint, and can be folded up side by side, through essentially 180 degrees. Each of the plurality of the rib sections 3 extending radially from the hub 1 can then be pivoted upwardly about the pivot pins 4 on the rib ends in order to bring the ribs vertically upward, clustered together above the hub 1. The loosely attached tent fabric is folded with the ribs into one compact bundle.

As mentioned above, the articulated joints of the ribs are constantly urged toward the open position by the torsion type springs 18, and with some motion supplied by the user, most of these joints can be snapped into position. The tent is thus very easily and quickly assembled by one person, by simply holding the tent by the hub member, then shaking it somewhat until the ribs extend outwardly and the articulated joints at least partially open. From there, each joint can be manually opened further until all of the joints are in the aligned 180 degree position.

As shown in FIG. 1, the assembled tent in accordance with the invention has a plurality of radially extending ribs, e.g. six ribs 3, each of which acts as one continuous flexible rib member when locked in this position. Each rib is flexed in the fully assembled tent into a continuously curving configuration as shown, placing tension on the tent to hold it in the opened, dome-like configuration illustrated.

What is claimed is:

1. A central hub member assembly for the apex of a tent framework which supports a tent, comprising, a circular disk, a generally circular joint plate formed at the center of the disk so as to project upwardly from the disk, the joint plate being formed integrally with the disk, a plurality of generally U-shaped concave openings spaced radially around the periphery of the joint plate with the open ends of the U-shapes facing radially outwardly, each for receiving the end of a supporting rib of the tent framework, a joint groove located on each of the two side walls of each U-shaped opening such that the joint grooves face one another, two hanging jaw devices positioned opposite each other, one in each joint groove, a plurality of ribs, one for each U-shaped opening, each rib having an end with a pair of joint pins extending laterally outwardly from the end of the rib, the two pins being substantially on a common axis, the rib end, the pins and the U-shaped opening and joint grooves being so configured that the rib end can be inserted into the U-shaped opening with the pins at 90 degrees to the joint grooves, then the rib can be rotated 90 degrees and can be pulled up to engage the pins in the joint grooves to be held therein by the hanging jaw devices, whereby the rib will be free to pivot about the axis of the pins, and a plurality of frame grooves spaced radially about the periphery of the disk and located immediately adjacent to each U-shaped opening, each frame groove forming a recess in the disk into which the rib can rest when pivoted downwardly to a position wherein the rib is generally in a common plane with the hub member.

2. The tent of claim 1, wherein each rib further comprises two joints, each said rib joint includes spring means urging the rib joint toward an opened, aligned position.

3. The tent of claim 1, wherein each rib further comprises two joints, each said rib joint includes locking means for snapping into place and locking the joint against folding, and further including means for limiting the joint against over-pivoting beyond an aligned position.

4. The tent of claim 3, wherein the locking means of each rib joint includes a spring positioned to urge the locking means to the locked position so that it snaps into the aligned, locked position automatically upon being opened to the aligned position.

* * * * *